US005156198A

United States Patent [19]

Hall

[11] Patent Number: 5,156,198

[45] Date of Patent: Oct. 20, 1992

[54] PUMP LOCK FUEL SYSTEM

[76] Inventor: Gerald L. Hall, 2114 McCormick, Denton, Tex. 76250

[21] Appl. No.: 657,859

[22] Filed: Feb. 20, 1991

[51] Int. Cl.[5] ..... B65B 1/30; B67C 3/02

[52] U.S. Cl. ..... 141/94; 340/572; 141/98; 141/96

[58] Field of Search ..... 141/94, 95, 96, 98, 141/DIG. 1; 340/572

[56] References Cited

U.S. PATENT DOCUMENTS

| | | | |
|---|---|---|---|
| 3,410,320 | 11/1968 | Ginsburgh et al. | 141/98 |
| 4,263,945 | 4/1981 | Van Ness | 141/98 |
| 4,469,149 | 9/1984 | Walker et al. | 141/94 |
| 4,846,233 | 7/1989 | Fockens | 141/94 |
| 4,934,419 | 6/1990 | LaMont et al. | 141/94 |
| 4,940,968 | 7/1990 | De Nood | 340/572 |
| 4,945,339 | 7/1990 | Yamuchi et al. | 340/572 |

FOREIGN PATENT DOCUMENTS

| | | | |
|---|---|---|---|
| 2502134 | 9/1982 | France | 141/94 |
| 226593 | 9/1989 | Japan | 141/95 |
| 1341156 | 9/1987 | U.S.S.R. | 141/94 |
| 2159495 | 12/1985 | United Kingdom | 141/94 |

*Primary Examiner*—Henry J. Recla
*Assistant Examiner*—Keith Kupferschmid
*Attorney, Agent, or Firm*—John E. Vandigriff

[57] ABSTRACT

A fuel lock and dispensing system utilizes a data transformer made up of the dispensing nozzle inserted into the fuel tank filler pipe or opening, two pairs of coils, one pair on the hose or nozzle and one pair on the fuel tank filler pipe. A vehicle on-board computer and a fuel pump computer can communicate with each other through the data transfer transformer.

11 Claims, 1 Drawing Sheet

10

PUMP LOCK FUEL SYSTEM

FIELD OF THE INVENTION

This invention relates to fuel transfer control systems, and more particularly to a system for providing a communication link between a vehicle and a fuel distribution system prior to pumping fuel to the vehicle.

BACKGROUND OF THE INVENTION

Most prior art fuel distribution systems require an operator input or visual means to identify a vehicle, and allow the pumping of fuel to the vehicle. A system disclosed in U.S. Pat. No. 4,934,419 requires the operator to line up elements for communication, modification of the vehicle, modification of a fuel pump and nozzle, and the system can be defeated by aligning communication elements but not inserting the fuel nozzle into the fuel tank.

In U.S. Pat. No. 3,410,320 the operator is required to manually input information. The information input to the system identifies the type of vehicle, i.e. Ford, Chevrolet, etc.

A system disclosed in U.S. Pat. No. 3,527,268 uses a silhouette to identify the vehicle. A card may be used, and in one example, a card is read through the windshield of the vehicle.

Other systems are found in the prior art. These various systems require operator input, but does not require vehicle identification. Some systems use radio controlled pumps but also require an operator.

BRIEF SUMMARY OF THE INVENTION

The invention is a pump lock fuel dispensing system that permits the pumping of fuel to vehicles identified by the system and maintains a temporary record of the fuel supplied to the vehicle. The system only pumps fuel after the pump nozzle is inserted in the fuel tank and the vehicle is identified. The system is inexpensive when compared with present day systems, and can be utilized for one vehicle and one pump, but may be expanded with the addition of a remote computer to monitor an unlimited number of pumps at any one location.

Each vehicle has an on board computer and there is one computer for each pump. There is a set of coils transmit and receive, on the neck of the fuel tank of the vehicle and there is a set of coils, transmit and receive, associated with the fuel pump nozzle. The nozzle and the fuel tank neck or filler pipe form a common core transformer allowing communications between the sets of coils.

Initially, when power is turned on to the pump, the transmit coil on the pump nozzle is in a magnetically saturated state.

The first pulse applied to the transmit coil turns the magnetic field around the transmit coil off for 1 microsecond, causing a burst of noise to be generated in the receive coil on the fuel tank neck. This pulse may be, for example, 30 nanoseconds wide with an amplitude sufficient to break the trigger threshold voltage on a single shot multivibrator. The time duration of the driven single shot is sufficient to establish and maintain an RS-232 communications link.

An on board computer is interrogated by the pump computer via the RS-232 communication link. The pump computer identifies the vehicle and the amount of fuel supplied to the vehicle. Other information may be maintained, such as vehicle mileage since last time fuel was received, the date of such fueling, and vehicle time of actual use.

The technical advance represented by the invention as well as the objects thereof will become apparent from the following description of a preferred embodiment of the invention when considered in conjunction with the accompanying drawings, and the novel features set forth In the appended claims.

DESCRIPTION OF A PREFERRED EMBODIMENT

Figure 1:
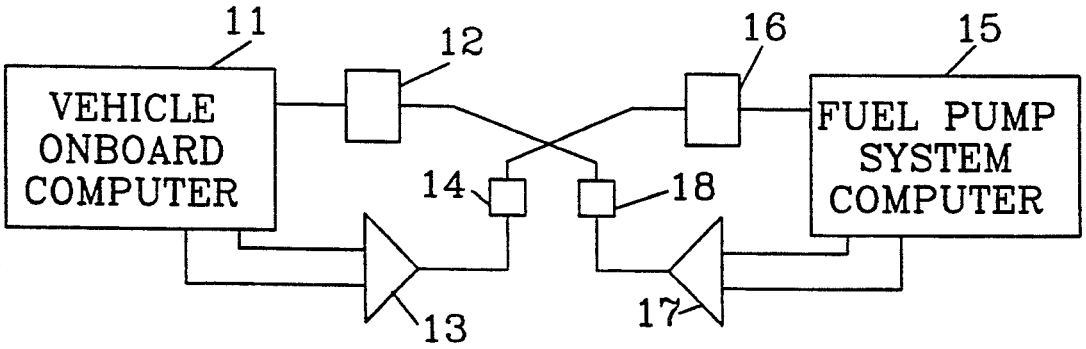
FIG. 1 is a block diagram of the pump lock fuel dispensing system of the present invention.

FIG. 1 is a block diagram of the pump lock fuel dispensing system 10 of the present invention. Each vehicle to be managed in the system has an on-board-computer 11 that interfaces with various vehicle functions, such as miles traveled, time used, fuel consumption, dates and time that the vehicle is refueled, and any other feature that can be monitored. Each computer 11 has programmed or stored therein an identification code for the vehicle in which it is installed. Computer 11 is connected to an interface 18 through a gate 12. Information received from an outside source is couple through interface 18 and directed to gate 12. Gate 12 then informs computer 11 that it has been coupled to a source of data. The computer then acknowledges that it has been notified that it is to receive data and sends an acknowledgment signal and identification signal through gate 13.

A fuel dispensing pump computer 15 is coupled to interface 18 through gate 17. Gate 13, associated with computer 11 is coupled through interface 14 to gate 16. In a manner similar to that described above for computer 11, computer 15 is advised that data is to be received through interface 14 and gate 16. Computer 11 then sends an acknowledgment through gate 17 to computer 11 via interface 18 and gate 12.

Figure 2:
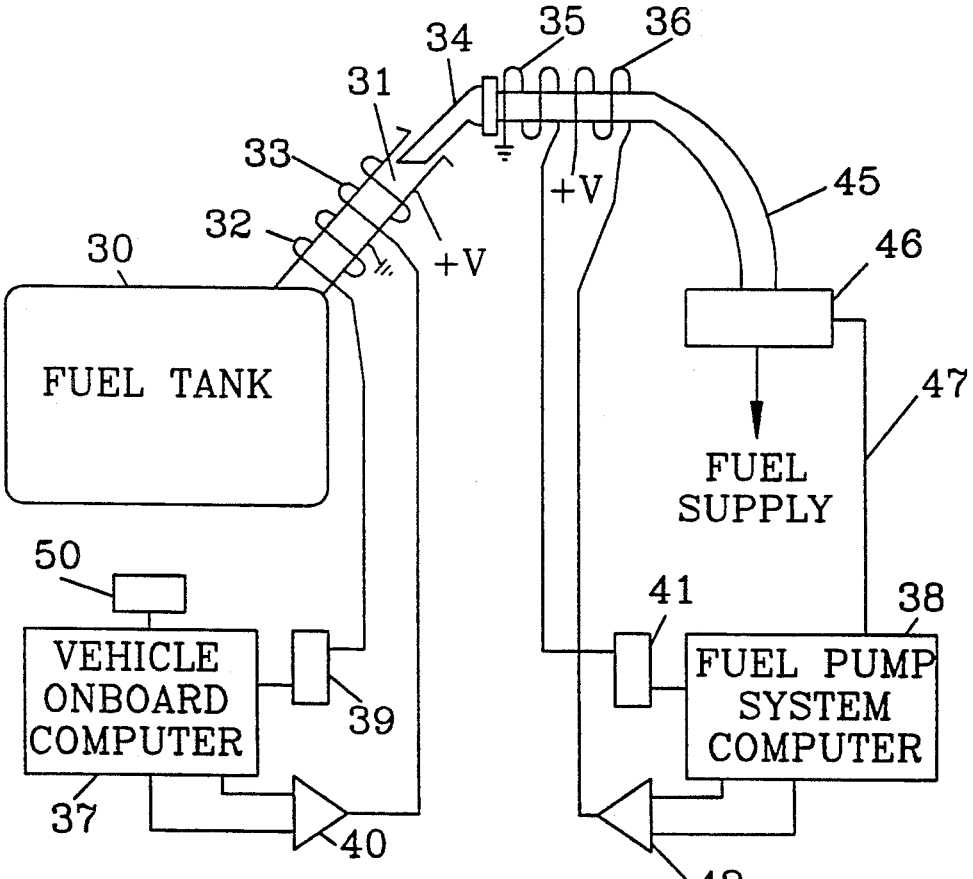
FIG. 2 illustrates the fuel lock system and the interconnection of its functional parts.

FIG. 2 shows a preferred embodiment of the invention illustrating the functional aspects of the invention. A vehicle gasoline or diesel tank 30 has a filler pipe 31 extending from the top of the tank and is used to introduce fuel into the tank. Filler pipe 31 has two electrical coils 32 and 33 around and electrically insulated from the filler pipe. Coils 32 and 33 are connected to vehicle computer 37 and are used to receive signals to be transmitted to the computer and to send signals being generated by the computer. Coil 32 is a receive coil and is coupled to computer 37 through gate 39. Coil 33 is connected to computer 37 by gate 40. The functions and operation of gates 39 and 40 are described below with reference to the operation of the fuel lock system. Computer 37 is connected to various functions of the vehicle via interface 50. Such functions may include miles traveled, time of operation of the vehicle, and any function that may be useful in maintaining a record of use of the vehicle.

A second computer 38 is connect to and associated with a fuel pump 46 and dispensing nozzle 34. Fuel nozzle 34 has two electrical coils 35 and 36 mounted thereon. Coils 35 and 36 are insulated from the nozzle. Coil 35 is a signal receiving coil and coil 36 is a data transmitting coil. Coil 35 is coupled to computer 38 by gate 41 and coil 36 is connected to computer 38 by gate 42.

Nozzle 34 is connected to dispensing hose 45 which is connected to fuel pump 46. Fuel pump 46 is connected to a fuel supply reservoir and to computer 38 via control line 47.

The basic operation of the system begins when nozzle 34 is inserted into fuel tank filler pipe 31. Nozzle 34 and fuel tank filler pipe 31 form the core of a transformer which includes windings 32, 33, 35 and 36. After nozzle 34 is inserted into filler pipe 31, power is turned on and coil 36 comes on in a saturated state. Coil 36 has one end connected to a positive voltage source and the other end is connected to the send gate 42. A first pulse, approximate 1 microsecond long, from computer 38 is coupled to vehicle receive coil 32. The received pulse is transmitted to gate 39.

Data is represented in binary form by bursts of noise that are coupled into the receive coils in that a burst of noise equals a one and no burst of noise equals a zero. These burst of noise are generated by simply collapsing the magnetic field held in the transmit coils.

Gate 39 is, for example, a one shot multi-vibrator, which is triggered by received pulse in coil 32. The pulse out of multi-vibrator 39 is sufficient to establish communications between vehicle computer 37 and pump computer 38.

Subsequent pulses transmitted by the station computer are received by vehicle computer 37. Pump computer 38 interrogates vehicle computer 37 for vehicle identification and other data monitored by the vehicle computer.

Communication from the vehicle computer 37 is by an RS-232C connection that is transmitted through gate 40. A clock pulse is also applied to gate 40 to synchronize the transmission with the computer clock. The output of gate 40 is coupled to coil 33 Coupling between coil 33 and coil 35 transmits the output of vehicle computer 37 to gate 41 Gate 41 is a one shot multi-vibrator, the output of which is connected to pump computer 38. Pump computer 38 outputs data and interrogation signals via gate 42 to transmit coil 36. This data is coupled to receive coil 32. Gate 42 is also connected to the clock of computer 38.

Synchronization is accomplished by the vehicle computer always being passive (waiting) and the pump computer always being active (calling).

Once communications has been established between vehicle computer 37 and pump computer 38, and the vehicle has been identified as a vehicle that can be fueled at the station, computer 38 turns on power to pump 46 via control line 47, allowing fuel to be pumped in to fuel tank 30. If the nozzle is removed from the fuel tank filler pipe, communications is broken and the fuel pump is turned off.

A simple system is formed in that these two computers are all that is required for fuel security. An additional computer system may be used to collect the information from pump computer(s) for storage and transfer to a data processing terminal.

The fuel lock system is an improvement on prior system since the fuel pump nozzle must be positioned into the fuel tank filler pipe prior to the gas pump being turned on, and is a requirement to establish communications between the vehicle on board computer and the fuel pump computer. In prior systems, fuel could be pumped into other vehicles after the fuel pump was turned on, and the prior art systems required operator input to the system. Communications between the vehicle computer and pump computer is automatic in the present invention when the fuel nozzle is inserted in the vehicle fuel filler pipe.

What is claimed:

1. A fuel system pump lock and identification system, wherein data from a vehicle computer is used to identify the vehicle, to transfer data to and from the vehicle computer to a fuel pump computer, and to unlock the fuel pump, the fuel pump lock system comprising:

a fuel tank having a fuel filler pipe;

a first pair of electrical transmit/receive coils located on the fuel filler pipe;

a fuel pump having a nozzle for dispensing fuel;

a second pair of electrical transmit/receive coils located on said nozzle;

a vehicle on-board computer connected to said first pair of electrical coils;

a fuel pump computer connected to said second pair of electrical coils;

wherein a two-way communications link is established between said vehicle on-board vehicle computer and said fuel pump computer through said first and second pair of electrical coils only when the fuel pump nozzle is inserted in the fuel filler pipe.

2. The fuel system according to claim 1, wherein said fuel filler pipe, fuel pump nozzle, first pair of electrical coils and said second pair of electrical coil form a transformer to provide signal coupling between said first and second pairs of electrical coils.

3. The fuel system according to claim 1, wherein said fuel pump computer generates one or more pulses that are coupled to said vehicle on-board computer via one of said first pair of coils on said nozzle and one of said second pair of coils on said filler pipe only when the nozzle is inserted in the fuel filler pipe of the vehicle, and said on-board computer responding to said one or more pulses to send pulses and data to said fuel pump computer via one of said first and one of second pairs of electrical coils and a communications link connected between the on-board computer, fuel pump computer, and said first and second pairs of coils.

4. The fuel system according to claim 1, wherein communications is established between the on-board computer and fuel pump computer via a RS-232C communications link.

5. The fuel system according to claim 1, wherein fuel is dispensed from said fuel pump only when the fuel pump nozzle is inserted into said fuel tank filler pipe and communications is established between the on-board computer and the fuel pump computer.

6. The fuel system according to claim 1, wherein said first and second pairs of electrical coils, said fuel filler pipe, and said nozzle form a common core data transfer transformer when said nozzle is inserted in said fuel filler pipe.

7. In a fuel system pump lock and identification system wherein data from an on-board vehicle computer is used to identify the vehicle, to transfer data to and from the vehicle computer to a fuel pump computer, and to unlock the fuel pump; a data transfer transformer comprising:

a fuel filler pipe on a fuel tank;

a first pair of electrical transmit/receive coils located on the fuel filler pipe;

a nozzle on a fuel pump for dispensing fuel;

a second pair of electrical transmit/receive coils located on said nozzle;

the nozzle, only when inserted in the fuel filler pipe, the fuel filler pipe, and the first and second pairs of electrical receive/transmit coils forming a common core data transfer transformer;

wherein two-way communications is established between said on-board vehicle computer and said fuel pump computer through said common core data transfer transformer, only when the nozzle is inserted in the fuel filler pipe.

8. The fuel system according to claim 7 wherein said first pair of electrical coils includes a receive and transmit coil, and said second pair of electrical coils includes a receive and transmit coil.

9. In a fuel system lock and identification system in which data is transferred between a fuel system computer and a vehicle computer during fuel transfer from a pump nozzle through a fuel tank filler pipe, a data transfer transformer, comprising:

a first pair of coils on said pump nozzle;

a second pair of coils on said filler pipe;

said nozzle, first pair of coils, second pair of coils and filler pipe forming a data transfer transformer only when the pump nozzle is inserted in the filler pipe.

10. The system according to claim 9, wherein said filler pipe and nozzle form the core of the data transfer transformer.

11. A fuel system pump lock and identification system, wherein data from a vehicle computer is used to identify the vehicle, to transfer data to and from the vehicle computer to a fuel pump computer, and to unlock the fuel pump, the fuel pump lock system comprising:

a fuel tank having a fuel filler pipe;

a first pair of electrical transmit/receive coils located on the fuel filler pipe;

a fuel pump having a nozzle for dispensing fuel;

a second pair of electrical transmit/receive coils located on said nozzle;

a vehicle on-board computer connected to said first pair of electrical coils;

a fuel pump computer connected to said second pair of electrical coils;

wherein a two-way communications link is established between said vehicle on-board vehicle computer and said fuel pump computer, the data to establish the communication is defined as the binary representation of bursts of magnetic noise generated into the receive coils when the magnetic field of the transmit coils collapses.

* * * * *